US006290567B1

(12) United States Patent
Chiu

(10) Patent No.: US 6,290,567 B1
(45) Date of Patent: Sep. 18, 2001

(54) REMOTE-CONTROLLED WALKING TOY ANIMAL

(75) Inventor: Andrew Shun Pui Chiu, Kowloon (HK)

(73) Assignee: Ngai Keung Metal & Plastic Manufactory Ltd., Kowloon (HK)

( * ) Notice: Subject to any disclaimer, the term of this patent is extended or adjusted under 35 U.S.C. 154(b) by 0 days.

(21) Appl. No.: 09/496,629

(22) Filed: Feb. 2, 2000

(51) Int. Cl.[7] ..... A63H 11/20
(52) U.S. Cl. ..... 446/356
(58) Field of Search ..... 446/355, 356

(56) References Cited

U.S. PATENT DOCUMENTS 3,559,336 * 2/1971 Nozaki ..... 446/356
4,245,515 * 1/1981 Iwaya ..... 446/356 X
4,840,242 * 6/1989 Chih et al. ..... 446/356 X
6,036,572 * 3/2000 Sze ..... 446/355 X
6,210,249 * 4/2001 Stadlbauer ..... 446/356 X

* cited by examiner

*Primary Examiner*—John A. Ricci
(74) *Attorney, Agent, or Firm*—Hall, Priddy, Myers & Vande Sande

(57) ABSTRACT

A radio-controlled walking toy horse (10) is disclosed as including a body portion (14) containing an electric motor (28), four legs (16*a*, 16*b*, 16*c*, 16*d*) engaged with the body portion (14), in which the legs (16*a*, 16*b*, 16*c*, 16*d*) are movable by the motor (28) to move relative to the body portion (14) in a walking-like manner, and a position sensing and feedback device for stopping the motor (28) only when the legs (16*a*, 16*b*, 16*c*, 16*d*) rest on a common plane, whereby the toy horse (10) can support itself on a floor surface (52).

10 Claims, 6 Drawing Sheets

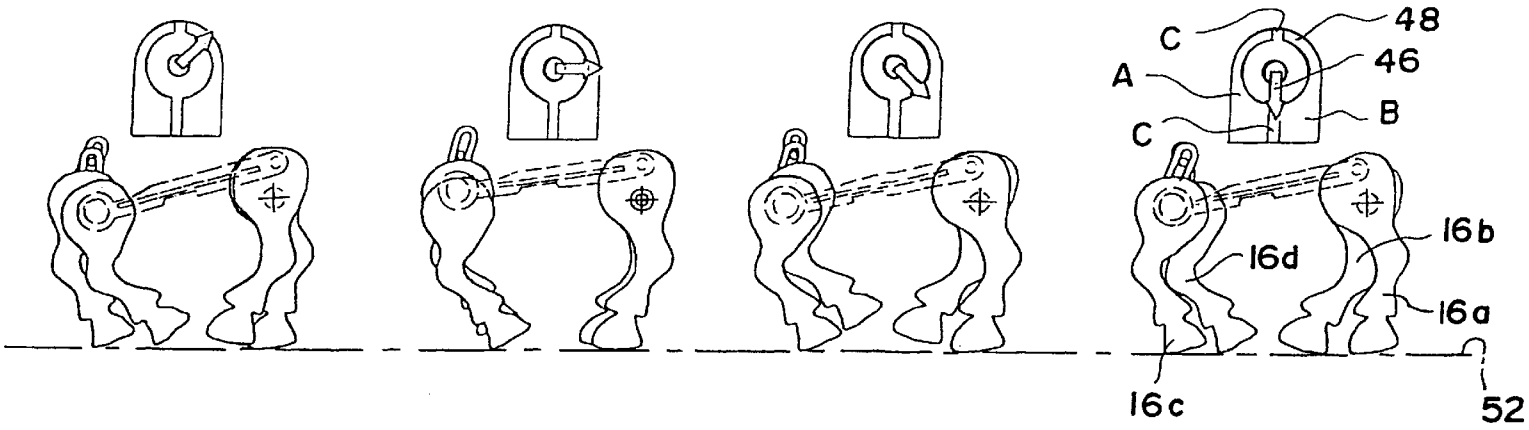
FIG. 4A
FIG. 4B
FIG. 4C
FIG. 4D
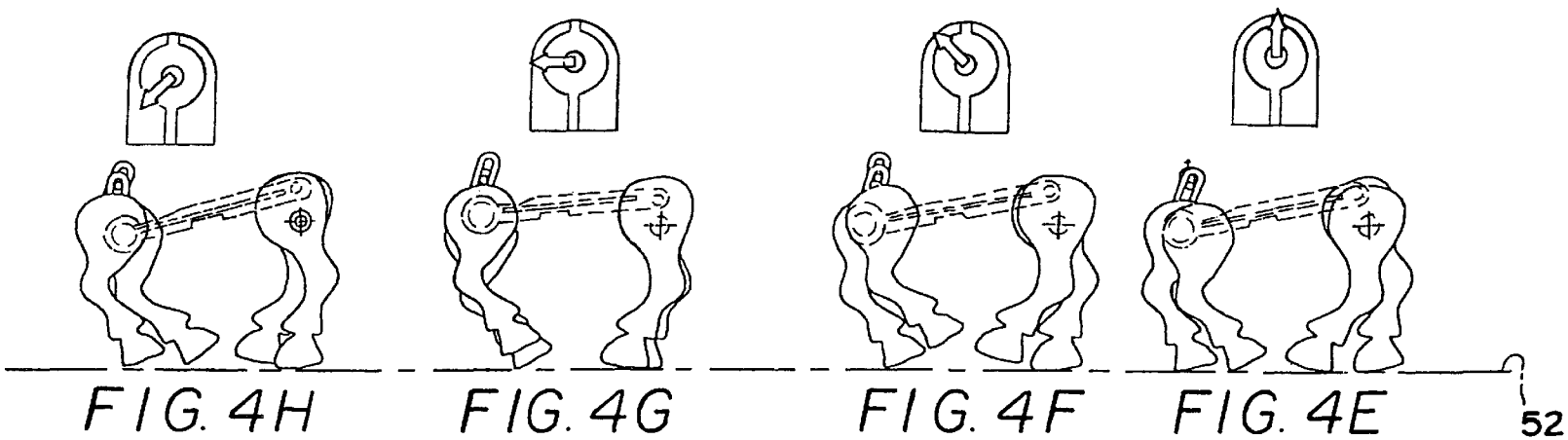
FIG. 4E
FIG. 4F
FIG. 4G
FIG. 4H

REMOTE-CONTROLLED WALKING TOY ANIMAL

This invention relates to a remote-controlled, e.g. radio-controlled, walking toy animal. In particular, this invention relates to a radio-controlled walking toy animal which includes a number of limbs the movement of which is designed to mimic that of actual animals.

BACKGROUND OF THE INVENTION

Electrically-operated four-legged free-walking toy animals, e.g. toy horses, have been available in the market. While attempts have been made to convert such toy animals from free-walking versions to a low-cost remote-controlled version, no low-cost commercial product is as yet known in the market.

There are technical difficulties in developing a low-cost remote-controlled walking toy animal. While it is relatively easy to control the toy animal to start walking, stop walking and to balance the toy animal during its walking movement, it is found in practice that once the toy animal stops walking, it will usually topple over because one or more of its legs is not on the floor level, and the toy cannot support itself on the remaining legs which rest on the floor level.

It is thus an object of the present invention to provide a walking toy animal in which the aforesaid shortcomings are mitigated, or at least to provide a useful alternative to the public.

SUMMARY OF THE INVENTION

According to the present invention, there is provided a toy animal comprising a body member containing an electric motor; a plurality of limb members engaged with said body member, which limb members being movable by said motor to move relative to said body member in a walking-like manner; and means adapted to stop said motor only when said limb members are in a predetermined position or one of a plurality of predetermined positions.

BRIEF DESCRIPTION OF THE DRAWINGS

A preferred embodiment of the present invention will now be described by way of an example only, and with reference to the accompanying drawings, in which:

FIGS. 4A to 4H show a cycle of walking movement of the legs of the toy animal shown in FIG. 1;

DETAILED DESCRIPTION OF THE PREFERRED EMBODIMENT

Figure 1:
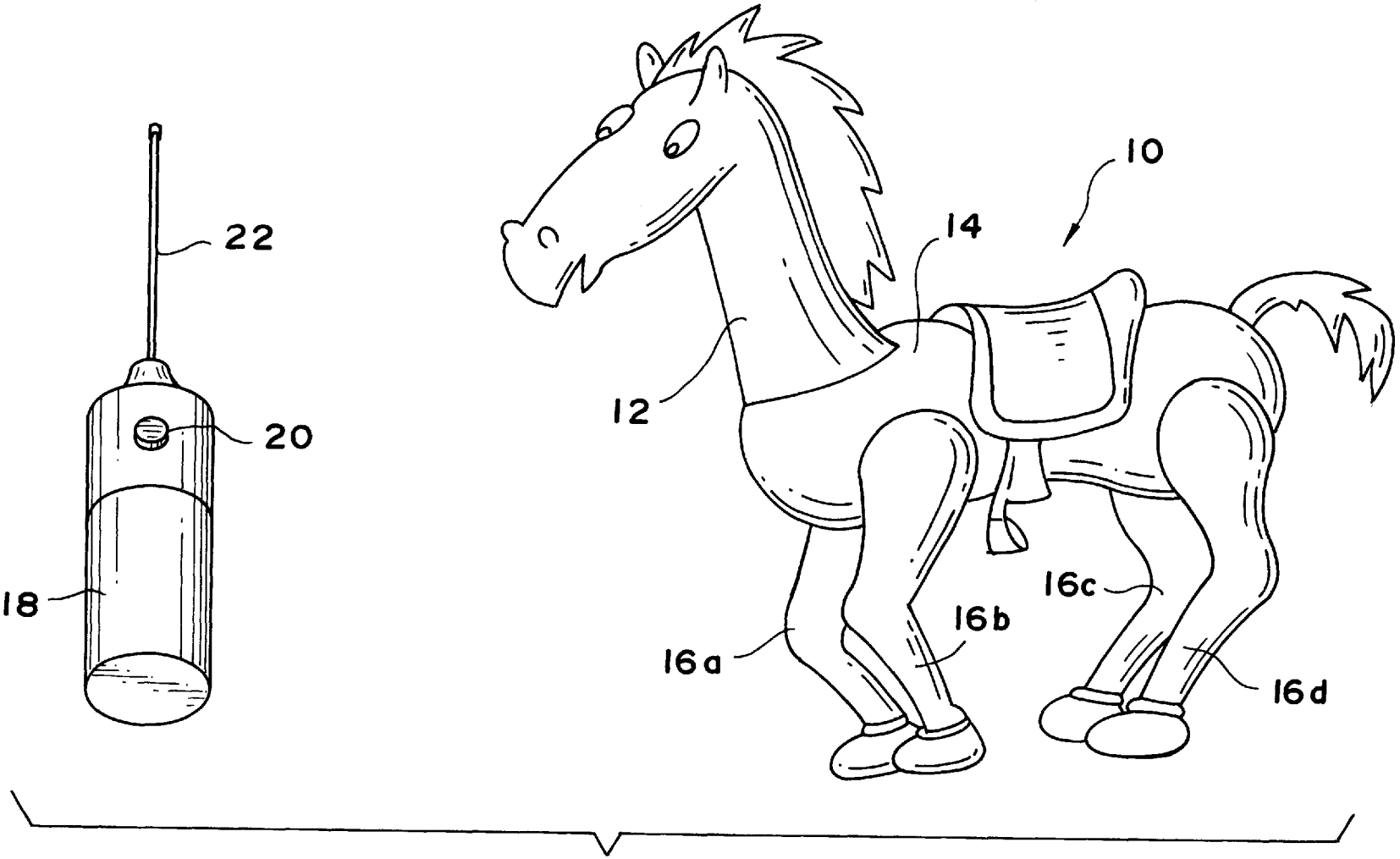
FIG. 1 shows the outlook of a toy animal together with a remote control apparatus.

As shown in FIG. 1, a toy animal according to the present invention is generally shown in the form of a toy horse 10, although it should be understood that the toy may be in the shape of other animals, e.g. dogs or cows. The toy horse 10 includes a head 12, a generally elongate body portion 14, and four legs 16*a*, 16*b*, 16*c*, 16*d*. The head 12 and the legs 16*a*, 16*b*, 16*c*, 16*d* are all movable relative to the body portion 14 in ways to be described later. The operation of the toy horse 10 is controlled by a remote control apparatus 18, which includes an ON/OFF button 20 and an antenna 22, for transmission of radio frequency signals to be received by the toy horse 10.

Figure 2A:
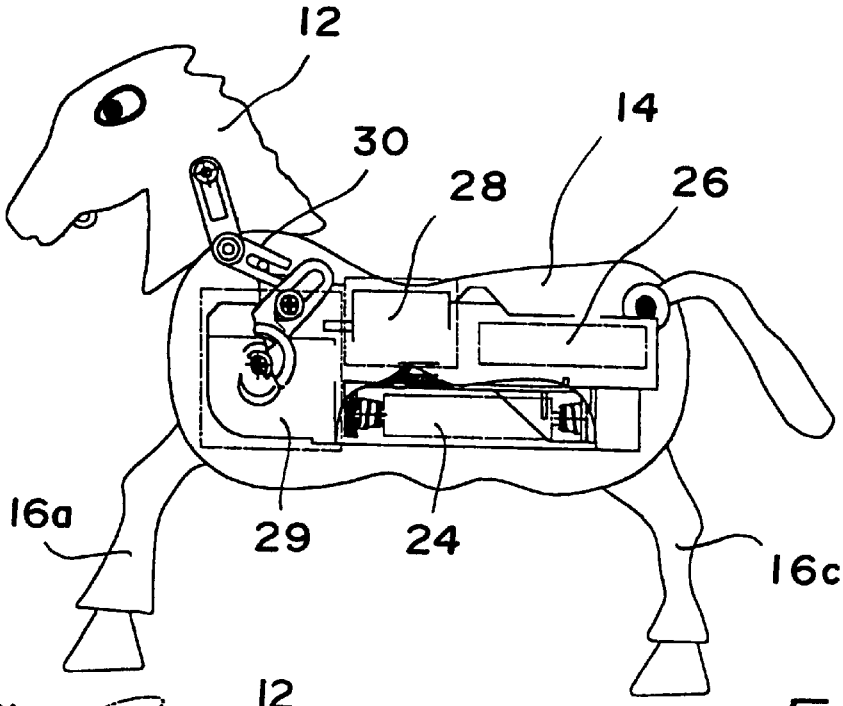
FIG. 2A shows a first schematic diagram of the internal arrangement of the toy animal shown in FIG. 1.
Figure 2B:
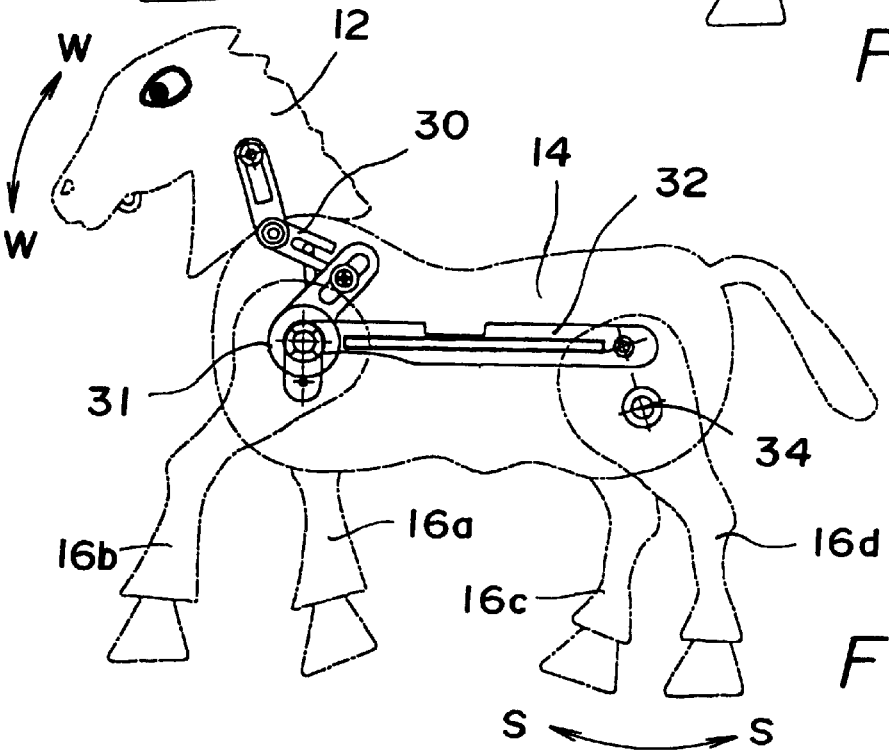
FIG. 2B shows a second schematic diagram of the internal arrangement of the toy animal shown in FIG. 1.

As shown in FIGS. 2A and 2B, the toy horse 10 is powered by a number of dry batteries 24 (of which only one is shown here) housed in the interior of the body portion 14. Also contained in the body portion 14 are a radio signal receiver (not shown in these two figures), an electric module 26 provided with logic circuits to be discussed below, a direct current (d.c.) motor 28, a gear box 29, a head movement cam 30, and two leg movement cams 31 (of which only one is shown in these two figures). Each of the leg movement cams 31 is linked to a respective leg 16*c*, 16*d* via a respective connecting bar 32, of which only one is shown here. The legs 16*c*, 16*d* are engaged with the body portion 14 via an axle 34 about which the legs 16*c*, 16*d* may swivel.

By way of the arrangement shown in FIGS. 2A and 2B, the legs 16*a*, 16*b* can exhibit movement which mimic the walking movement of the fore-legs of a horse, the legs 16*c*, 16*d* can exhibit a swiveling movement about the axle 34 in the directions shown by the bi-directional arrow S—S, and the head 12 can also exhibit a swiveling movement in the directions shown by the bi-directional arrow W—W.

Figure 3:
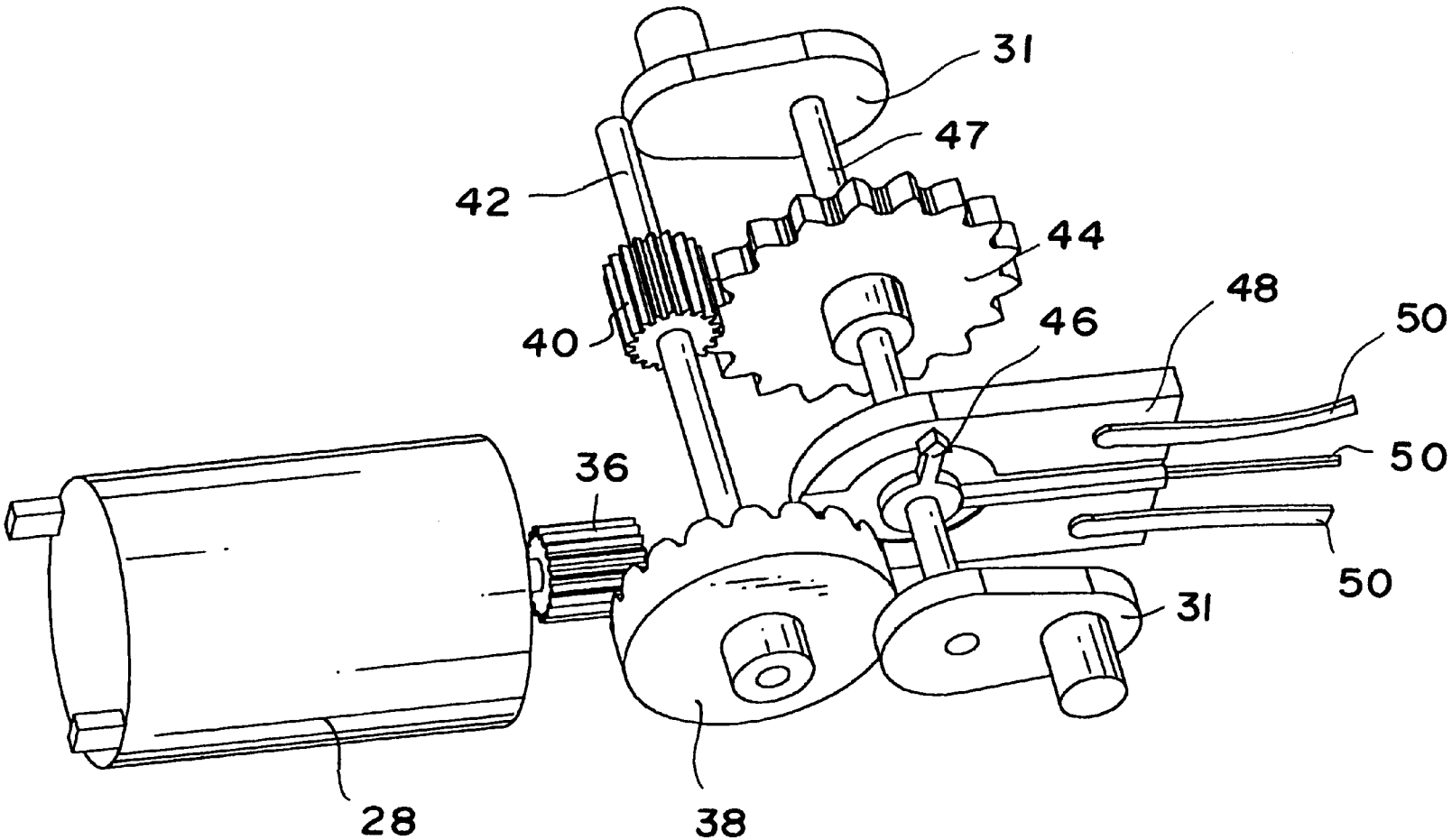
FIG. 3 shows the motion transmission system and position sensing system of the toy animal shown in FIG. 1.

FIG. 3 shows a reduction gear assembly in the gear box 29, together with a position sensing and feedback device used in the present invention. As can be seen, the d.c. motor 28 includes a motor pinion gear 36 meshed with a crown gear 38. The crown gear 38 is rotatable synchronously with a pinion 40 about a common shaft 42. The pinion 40 is meshed with a flat gear 44, which rotates synchronously with the leg movement cams 31 and a brush 46 about a common shaft 47. By way of such an arrangement, the motion of the motor pinion gear 36 can be transmitted to the cams 31, and thereby to the legs 16*a*, 16*b*, 6*c*, 16*d*, with which the cams 31 are engaged.

The brush 46 is made of an electrically conducive material, and can revolve on a plate 48, and together constitute part of the position sensing and feedback device. During its rotation, the brush 46 comes into contact with one of three different electrically conductive areas on the plate 48. Each of the areas is connected with an electrically conductive wire 50, which transmits electrical signals to the electric module 26. Such signals can act as an indicator of the position of the brush 46 on the plate 48. As the movement of the brush 46 is synchronized with that of the legs 16*a*, 16*b*, 16*c*, 16*d*, the signals will thus also act as an indicator of the position and configuration of the legs 16*a*, 16*b*, 16*c*, 16*d*. This relationship is shown more clearly in FIGS. 4A to 4H.

FIGS. 4A to 4H show a complete walking cycle of the legs 16*a*, 16*b*, 16*c*, 16*d*, on a substantially planar surface 52. In these drawings, for clarity purposes, the connecting bar 32 is shown in dotted lines. As can be seen, the plate 48 is divided into two main areas A, B by a gap C which separates the two areas A, B. In the situation as shown in FIG. 4A, all the hoof parts of the legs 16*a*, 16*b*, 16*c*, 16*d* rest on the surface 52. The toy horse 10 can thus support itself stably on the surface 52. It is so arranged that when the toy horse 10 assumes such a position, the brush 46 will lie over the gap C.

When the toy horse 10 begins to walk, the legs 16*b*, 16*d* start to move and will occupy the position as shown in FIG. 4B in which they are above the surface 52. In this position, the brush 46 is in contact with the area B. As the toy horse 14 moves on, the legs 16*a*, 16*b*, 16*c*, 16*d* will assume the position shown in FIG. 4C in which the leg 16*d* is above the surface 52. In this position, the brush 46 has rotated further from its previous position shown in FIG. 4B, although it is still in contact with the area B. Subsequently, the toy horse 10 will assume the position in FIG. 4D in which the legs 16*a*, 16*c* are above the surface 52. In this position, the brush 46 is still in contact with the area B.

When the toy horse 10 proceeds further with the walking movement, the legs 16*a*, 16*b*, 16*c*, 16*d* will occupy the position and configuration shown in FIG. 4E, in which they will again rest on the surface 52, and the toy horse 10 can support itself stably. It can be seen that, in such a position, the brush 46 again lies over the gap C, although it is 180° from its position as shown in FIG. 4A. As the walking movement continues, the legs 16*a*, 16*b*, 16*c*, 16*d* will consecutively assume the positions and configurations shown in FIGS. 4F, 4G and 4H. In these three positions, the brush 46 is in contact with the area A of the plate 48. Afterwards, the legs 16*a*, 16*b*, 16*c*, 16*d* will again assume the position and configuration shown in FIG. 4A, and a new walking movement cycle may start.

From the above analysis, it can be seen that the toy horse 10 can only stably support itself on the surface 52 when its legs 16*a*, 16*b*, 16*c*, 16*d* assume the position and configuration shown in FIG. 4A or 4E. In both these situations, the brush 46 will lie over the gap C. The toy horse 10 cannot support itself on the surface 52 if it stops at any other position or configuration, e.g. those shown in FIGS. 4B to 4D, and 4F to 4H. However, during the walking movement, as the legs 16*a*, 16*b*, 16*c*, 16*d* move relatively quickly, the toy horse 10 can move forward without falling down.

Figure 5:
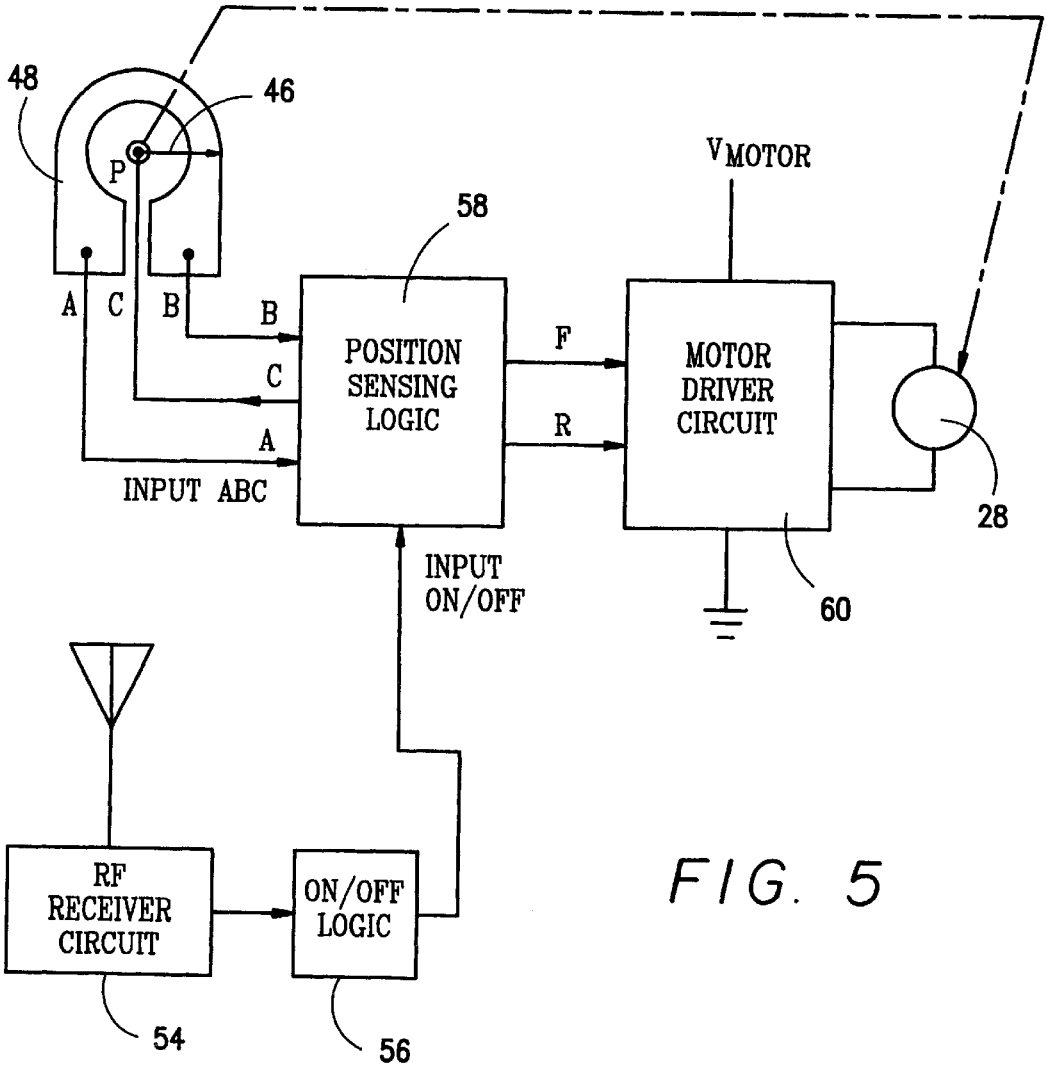
FIG. 5 shows a schematic diagram of the sensing and feedback function of the toy animal shown in FIG. 1.

FIG. 5 is a schematic diagram showing the sensing and feedback function of the toy horse 10. The toy horse 10 includes a radio frequency receiver circuit 54 for receiving radio frequency signals transmitted by the remote control apparatus 18. In particular, radio frequency signals will be transmitted by the control apparatus 18 when the ON/OFF button 20 is pressed to activate the apparatus 18. Such received signals are then transmitted to an ON/OFF logic 56, which transmits an "ON" signal or an "OFF" signal to a position sensing logic 58 in accordance with the presence or absence of signals from the radio frequency receiver circuit 54.

In addition to receiving input from the ON/OFF logic 56, the position sensing logic 58 also receives input from the position feedback device. In particular, the position logic 58 receives input from the wires 50 connected to the plate 48. The position sensing logic 58 will transmit signals to a motor driving circuit 60, depending on the inputs received from the ON/OFF logic 56 and the wires 50, and in accordance with the following Table A.

TABLE A

| INPUT ON/OFF | INPUT ABC | OUTPUT |
|---|---|---|
| OFF | P = B | R |
| OFF | P = A | F |
| OFF | P = C | STOP |
| ON | — | F |

In the above Table A, "P=B" means that the brush 46 is in contact with the area B of the plate 48, "P=A" means that the brush 46 is in contact with the area A of the plate 48, and "P=C" means that the brush 46 lies over the gap C of the plate 48, "R" means "rearward", and "F" means "forward".

It can be seen that:

a. when the input from the ON/OFF logic 56 is "ON", the input from the plate 48 will be ignored and the position sensing logic 58 will output an "F" (forward) signal to the motor driver circuit 60;

b. when the input from the ON/OFF logic 56 is "OFF", the output from the position sensing logic 58 will depend on the position of the brush 46, as follows:

i. if P=B, i.e. if the brush 46 is in contact with the area B, the position sensing logic 58 will output an "R" (rearward) signal to the motor driver circuit 60;

ii. if P=A, i.e. if the brush 46 is in contact with the area A, the position sensing logic 58 will output an "F" (forward) signal to the motor driver circuit 60; and iii. if P=C, i.e. if the brush 46 lies over the gap C, the position sensing logic 58 will not output any signal to the motor driver circuit 60, which is equivalent to outputting a "STOP" signal to the motor driver circuit 60.

The motor driver circuit 60 will operate the motor 28 depending on the input received from the position sensing logic 58, and in accordance with the following Table B.

TABLE B

| R | F | MOTOR |
|---|---|---|
| 0 | 0 | STOP |
| 0 | 1 | F |
| 1 | 0 | R |
| 1 | 1 | STOP |

According to the above Table B:

a. if there is neither an "R" input nor an "F" input from the position sensing logic 58, the motor 28 will stop;

b. if there is an "F" input, but not an "R" input, from the position sensing logic 58, the motor 28 will move forward;

c. if there is an "R" input, but not an "F" input, from the position sensing logic 58, the motor 28 will move rearward; and d. if there is both an "R" input and an "F" input from the position sensing logic 58, the motor 28 will stop. In fact, this should be an illegal situation. However, for the sake of completeness, the motor 28 will be stopped if such a situation occurs.

Figures 6A, 6B:
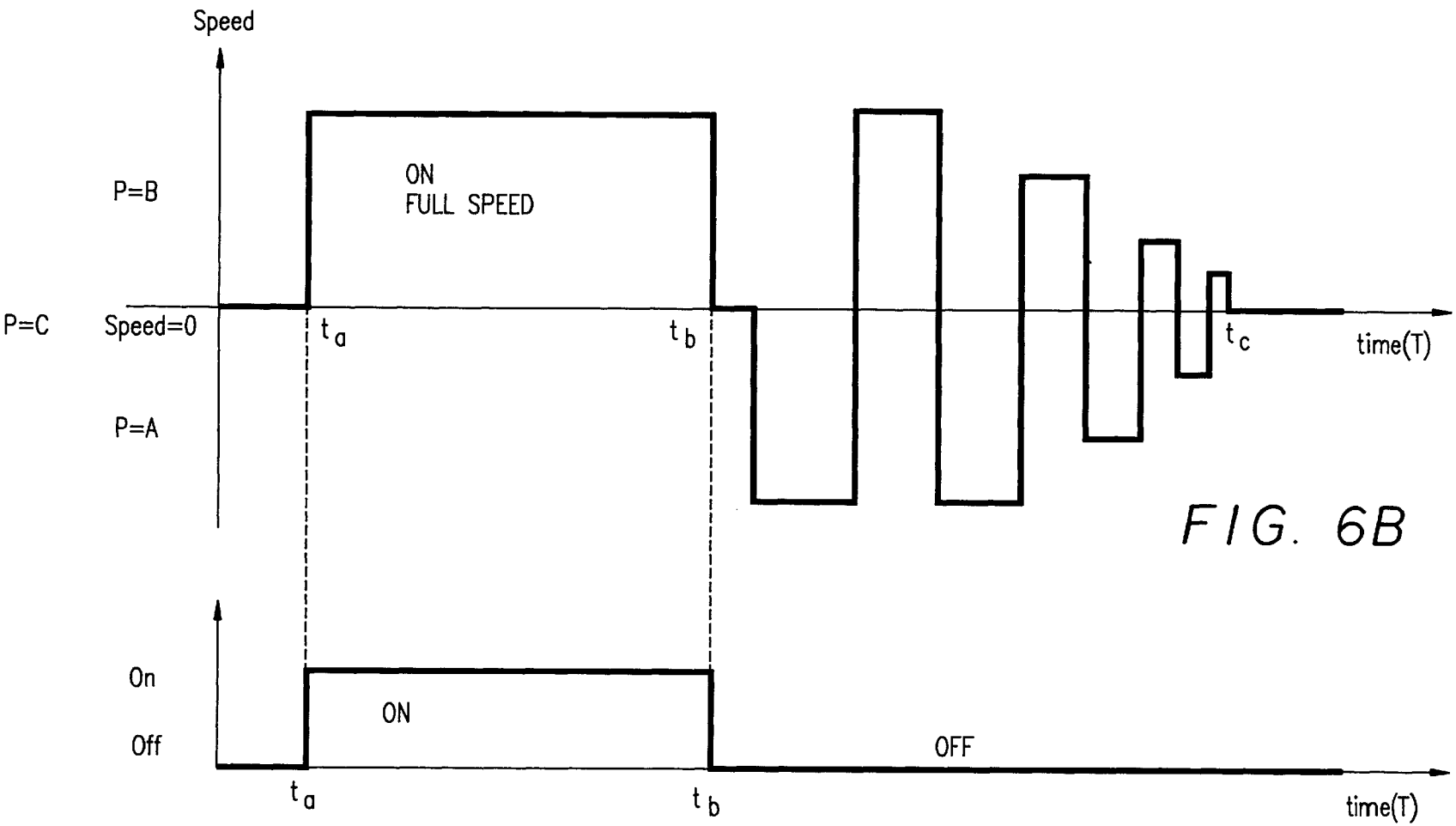
FIG. 6A is a timing diagram showing signals received by the toy animal shown in FIG. 1.
FIG. 6B shows a timing diagram of the operation of the electric motor of the toy animal shown in FIG. 1 in response to signals received as shown in FIG. 6A.

FIGS. 6A and 6B show in more detail the operation of the motor 28 by way of two timing diagrams. As shown in FIG. 6A, the ON/OFF button 20 of the remote control apparatus 18 is turned on from time $T=t_a$ to $T=t_b$. During this time period, according to Table A above, an "F" output will be outputted from the position sensing logic 58, and received by the motor driver circuit 60. Consequently, according to Table B, as there is only an "F" input, the motor 28 will be driven to move forward at full speed, thus causing the toy horse 10 to walk at full speed. When the ON/OFF button 20 is turned off at time $T=t_b$, the motor 28 will not automatically stop but will exhibit a series of oscillating movements, as shown in FIG. 6B and further discussed below.

Assuming that when the ON/OFF button 20 is turned off at time $T=t_b$, the brush 46 is in contact with the area B of the plate 48, then according to Table A, an "R" output will be outputted by the position sensing logic 58, and received by the motor driver circuit 60 which, according to Table B, will output an "R" output to drive the motor 28 to move rearward. This will then cause the brush 46 to rotate backward. Usually, however, the brush 46 will over-shoot the gap C, and come into contact with the area A of the plate 48. In this position, according to Table A, an "F" output will be outputted by the position sensing logic 58, and received by the motor driver circuit 60 which, according to Table B, will output an "F" output to drive the motor 28 to move forward. This will then cause the brush 46 to rotate forward. Such forward and rearward movements of the motor 28 may occur several times. The speed at which the motor 28, and thus the brush 46, move forward and backward will gradually decrease, until the brush 46 rests and lies over the gap C, e.g. at time $T=t_c$. At this time and in such a position, there will be no output "F" or "R" from the position sensing logic 58, and the output from the position sensing logic 58 will be "STOP". The motor 28 will then stop at this stage.

As discussed above, when the brush 46 lies over the gap C, the legs 16*a*, 16*b*, 16*c*, 16*d* of the toy horse 10 all rest on the same plane, e.g. the surface 52 in FIGS. 4A–4H. In such a situation, the toy horse 10 can support itself stably on its legs 16*a*, 16*b*, 16*c*, 16*d*.

It can thus be seen that, with the present invention, a remote-controlled walking toy animal will automatically find its balancing position even during the stopping action. In particular, when the on/off signal is turned to "OFF", the legs of the toy animal will continue to move and the position sensing logic will adjust the direction at which the motor moves, and the motor will only stop when all the legs are down on the ground position. With the oscillating motion of the rotation of the motor, the toy animal will appear to the player as being intelligent in seeking for itself the best stable position, with consequential interesting leg movements.

What is claimed is:

1. A toy animal comprising:

a body member containing an electric motor;

a plurality of limb members engaged with said body member, which limb members being movable by said motor to move relative to said body member in a walking-like manner; and means adapted to stop said motor only when said limb members are in a predetermined position or one of a plurality of predetermined positions.

2. A toy animal according to claim 1 wherein when said limb members are in the or each predetermined position, the respective distal end of the limb members which are most distant from said body member are substantially on a common plane.

3. A toy animal according to claim 1 wherein said limb members are movable by said motor via motion transmission means.

4. A toy animal according to claim 1 further comprising means associated with said motion transmission means for indicating the position of said limb members.

5. A toy animal according to claim 4 wherein said indicating means is rotatably movable.

6. A toy animal according to claim 5 wherein said indicating means is rotatably movable about an axis substantially transverse to a longitudinal axis of said body member.

7. A toy animal according to claim 4 wherein said motion transmission means includes at least one cam member.

8. A toy animal according to claim 7 wherein said indicating means is movable synchronously with said cam member(s).

9. A toy animal according to claim 4 wherein said stopping means is adapted to stop said motor only when said indicating means occupies a predetermined position or one of a plurality of predetermined positions.

10. A toy animal according to claim 4 further including means adapted to operate said motor according to the position occupied by said indicating means.

* * * * *